US007298995B2

(12) United States Patent
Mizobe

(10) Patent No.: US 7,298,995 B2
(45) Date of Patent: Nov. 20, 2007

(54) DEVELOPING DEVICE USED IN AN IMAGE FORMING APPARATUS

(75) Inventor: Takeo Mizobe, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 109 days.

(21) Appl. No.: 11/193,128

(22) Filed: Jul. 27, 2005

(65) Prior Publication Data

US 2006/0024092 A1 Feb. 2, 2006

(30) Foreign Application Priority Data

Jul. 30, 2004 (JP) ..... 2004-224800

(51) Int. Cl.
*G03G 15/09* (2006.01)

(52) U.S. Cl. ..... 399/272; 399/267; 430/110.4; 430/111.4; 430/122.1

(58) Field of Classification Search ..... 399/272, 399/267, 275, 277, 299; 430/122, 110.4, 430/111.4, 111.3, 122.1
See application file for complete search history.

(56) References Cited

U.S. PATENT DOCUMENTS 3,929,098 A 12/1975 Liebman ..... 399/282
5,740,511 A * 4/1998 Todome ..... 399/299 X
6,295,432 B1 * 9/2001 Inoue et al. ..... 430/122 X
6,485,876 B1 * 11/2002 Takezawa et al. ..... 430/110.4
7,031,642 B2 * 4/2006 Abe ..... 399/299 X
2001/0055503 A1 * 12/2001 Kin et al. ..... 399/284
2002/0025184 A1 * 2/2002 Ishikawa et al. ..... 430/110.4 X
2003/0003387 A1 * 1/2003 Xu et al. ..... 430/137.14
2003/0156862 A1 * 8/2003 Nishimura ..... 399/267
2003/0161666 A1 * 8/2003 Nishizawa et al. ..... 399/270
2004/0106058 A1 * 6/2004 Itoh ..... 430/110.2

FOREIGN PATENT DOCUMENTS

JP 06-067546 3/1994
JP 2003-255710 A * 9/2003
JP 2003-295613 10/2003
JP 2004-280092 A * 10/2004

* cited by examiner

*Primary Examiner*—Sophia S. Chen
(74) *Attorney, Agent, or Firm*—Hogan & Hartson LLP

(57) ABSTRACT

The developing device 100 includes a stirrer and transferor 122, 124, a magnetic roller 130, and a developing roller 140, that are disposed in a housing 110 which contains the two-component developing agent including the magnetic carrier and the non-magnetic toner, wherein volumetric mean particle size of the non-magnetic toner is set in a range from 6 to 11 μm and proportion of toner particles not larger than 4 μm is set to 8% by number or less, thereby making it possible to prevent imaging defect (ghost) and sticking of the toner onto the developing roller from occurring.

9 Claims, 6 Drawing Sheets

DEVELOPING DEVICE USED IN AN IMAGE FORMING APPARATUS

BACKGROUND OF THE INVENTION

1. Field of the Invention

The present invention relates to a developing device used in an image forming apparatus such as copying machine, printer or facsimile that utilizes electronic photography technique and, more particularly, to a developing device of non-contact developing system wherein a toner included in a developing agent held onto a magnetic roller is caused to deposit on the surface of a developing roller and then move onto an electrostatic latent image, thereby developing the electrostatic latent image.

2. Description of Related Art

There have been various methods employed by image forming apparatuses that utilize electronic photography technique. Single-drum color superposition system where images of different colors are formed successively on a single photosensitive body has been regarded as a promising technique that makes high-quality color imaging possible, since it allows full-color image formation with less color registration error by precisely depositing the toners of different colors one after another on the photosensitive body.

In recent years, meanwhile, much attention has been focused on tandem-drum system where images are formed with toners of different colors on a plurality of corresponding photosensitive bodies, and the images formed on the respective photosensitive bodies are superposed one after another on a transfer member in synchronization with feeding of the transfer member, thereby to form a full-color image. Although this system has an advantage of high-speed operation, there is such a disadvantage that one set of imaging means such as photosensitive bodies and a developing device must be provided for each color and arranged in tandem, thus resulting in larger size of the apparatus.

To counter this problem, such a compact tandem engine image forming apparatus is proposed that is provided with imaging means made smaller in size by decreasing the space between the photosensitive bodies. In the compact tandem engine image forming apparatus, it is advantageous to dispose the developing device in vertical construction in order to decrease the horizontal size of the imaging means. In other words, it is preferable that the members such as the developing roller, a magnetic roller, stirring-transfer means, etc. that constitute the developing device are disposed right above or obliquely above the photosensitive body, rather than in the same plane as the photosensitive body as in the case of the prior art.

In the case of a developing system that employs a two-component developing agent, however, decreasing the apparatus in size results in such problems as the deposition of carrier onto the photosensitive body and scattering of the toner. When the developing device is made smaller in vertical construction, in particular, circulation, of the developing agent, namely supply of the developing agent from a position near the stirring-transfer means to the developing roller, becomes so complicated that the problems of deposition of the carrier onto the photosensitive body and scattering of the toner become more conspicuous, thus imposing a limitation to the size reduction of the device.

Means for solving the problems of deposition of the carrier onto the photosensitive body are described in Patent Documents 1 through 3 described below that propose a developing device and an image forming apparatus provided with the developing device (hybrid developing system). The developing device comprises stirring-transfer means, a magnetic roller and a developing roller that are disposed in a housing, which contains a two-component developing agent. The stirring-transfer means transfers the developing agent while stirring it. The magnetic roller transfers the developing agent while holding it on the circumferential surface thereof. The developing roller is disposed to oppose the magnetic roller at a predetermined space therefrom and attracts the toner included in the developing agent held by the magnetic roller to deposit electrostatically thereon. With this system, deposition of the carrier onto the photosensitive body is suppressed and the problem of depletion of the carrier becomes less likely to occur, since the carrier does not fly toward the photosensitive body and returns to the magnetic roller even when a small amount of carrier moves from the magnetic roller to the developing roller and deposits thereon.

However, in the hybrid developing system described above, residual toner that has not been used in development and remains on the developing roller is scraped off by a magnetic brush provided on the magnetic roller, while some of the residual toner may not be completely cleaned and remain on the developing roller. When the residual toner is not completely cleaned, part of the previous picture may remain as a ghost in the next development process in the so-called hysteresis phenomenon (refer to FIG. 5). If the residual toner is not completely cleaned after development, there also occurs a problem that the toner sticks onto the developing roller and does not fly to the photosensitive body.

[Patent Document 1] Japanese Unexamined Patent Publication (Kokai) No. 6-67546 (FIGS. 1 and 2)

[Patent Document 2] Japanese Unexamined Patent Publication No. 2003-295613

[Patent Document 3] U.S. Pat. No. 3,929,098

SUMMARY OF THE INVENTION

An object of the present invention is to provide a developing device that is capable of preventing imaging defect (ghost) from taking place and toner from sticking onto the developing roller, a full-color image forming apparatus that is provided with the same, and a two-component developing agent.

The developing device of the present invention comprises stirring-transfer means, a magnetic roller and a developing roller that are disposed in a housing which contains a two-component developing agent comprising a magnetic carrier and a non-magnetic toner. The stirring-transfer means transfers the developing agent while stirring it. The magnetic roller has a magnetic sleeve and a plurality of magnetic poles disposed along the circumferential direction within the magnetic sleeve, and transfers the developing agent while holding it on the surface of the magnetic sleeve. The developing roller is disposed to oppose the magnetic roller at a predetermined space therefrom and attracts the toner included in the developing agent that is held by the magnetic roller to deposit electrostatically thereon. The non-magnetic toner has a volumetric mean particle size in a range from 6 to 11 μm, and proportion of toner particles not larger than 4 μm is 8% by number or less.

The inventor of the present application found that imaging defect (ghost) and sticking of the toner onto the developing roller can be prevented from taking place and good images can be obtained by controlling the volumetric mean particle size of the non-magnetic toner and particle size distribution on the side of small particle size within ranges suitable for the hybrid development system. When the proportion of toner particles not larger than 4 μm is higher than 8% by number, problems such as imaging defect (ghost) and sticking of the toner onto the developing roller become more likely to occur. When the volumetric mean particle size of the toner is less than 6 μm, it may become difficult for the toner to fly from the developing roller to the photosensitive body, thus resulting in lower image density. When the volumetric mean particle size of the toner exceeds 11 μm, on the other hand, resolution of the image may become lower.

The magnetic carrier of the present invention preferably has saturation magnetization of 35 to 50 emu/g and volumetric mean particle size of 35 to 50 μm. This makes it possible to reliably prevent the carrier from sticking onto the photosensitive body, for the carrier to separate more efficiently from the magnetic roller, and to form a more uniform thin toner layer on the developing roller.

The developing device of the present invention preferably has such a vertical constitution as the stirring-transfer means is disposed in the first quadrant and the developing roller is disposed in the third quadrant of an orthogonal coordinate system having the origin at the center of rotation of the magnetic roller. This constitution makes it possible to decrease the image forming apparatus in size. Moreover, such a constitution may be employed as the developing device and the toner container to be mounted on the developing device can be easily installed in and removed from the image forming apparatus from above, and simplify the jamming processing and other mechanisms.

The developing device of the present invention is preferably used in a tandem engine color image forming apparatus provided with a plurality of imaging means arranged in a substantially horizontal plane.

Other objects and advantages of the present invention will become apparent from the following detailed description.

DETAILED DESCRIPTION OF THE PREFERRED EMBODIMENTS

A developing device of the present invention and a tandem engine color image forming apparatus provided therewith will now be described in detail.

The developing device of the present invention is based on the hybrid development system described above, where a two-component developing agent consisting of a magnetic carrier and a non-magnetic toner is contained. The non-magnetic toner of the developing agent has a volumetric mean particle size in a range from 6 to 11 μm, and proportion of toner particles not larger than 4 μm is 8% by number or less. The magnetic carrier of the present invention preferably has saturation magnetization of 35 to 50 emu/g and volumetric mean particle size of 35 to 50 μm.

The toner of too large particle size results in low resolution. When particle size of the toner is too small, on the other hand, it may become difficult for the toner to fly from the developing roller to the photosensitive drum, and a proper image density cannot be achieved. Therefore, volumetric mean particle size of the toner is preferably in the range described above. When the proportion of toner particles not larger than 4 μm is higher than 8% by number, the toner sticks onto the developing roller surface thus leading to such problems as imaging defect (ghost) and low image density. In order to achieve a more finely formed magnetic brush on the magnetic roller surface and supply a sufficient amount of toner by the magnetic brush to the developing roller, volumetric mean particle size of the carrier is preferably in the range described above.

The volumetric mean particle size of the toner is measured by using Coulter Counter Multisizer II E (manufactured by Beckman Coulter, Inc.). 0.1 to 5 ml of a surface surfactant is added as a dispersant to 100 to 150 ml of an electrolyte solution (1% solution of NaCl in water prepared using extra pure sodium chloride), and 0.5 to 50 mg of specimen (toner) is added to suspend in the solution. Then the solution is subjected to dispersion process for about 1 to 3 minutes with an ultrasonic dispersing machine, before determining the particle volume distribution of the particles measuring from 2 to 40 μm in size by means of the Coulter Counter Multisizer II E using a 100 μm aperture.

Figure 6:
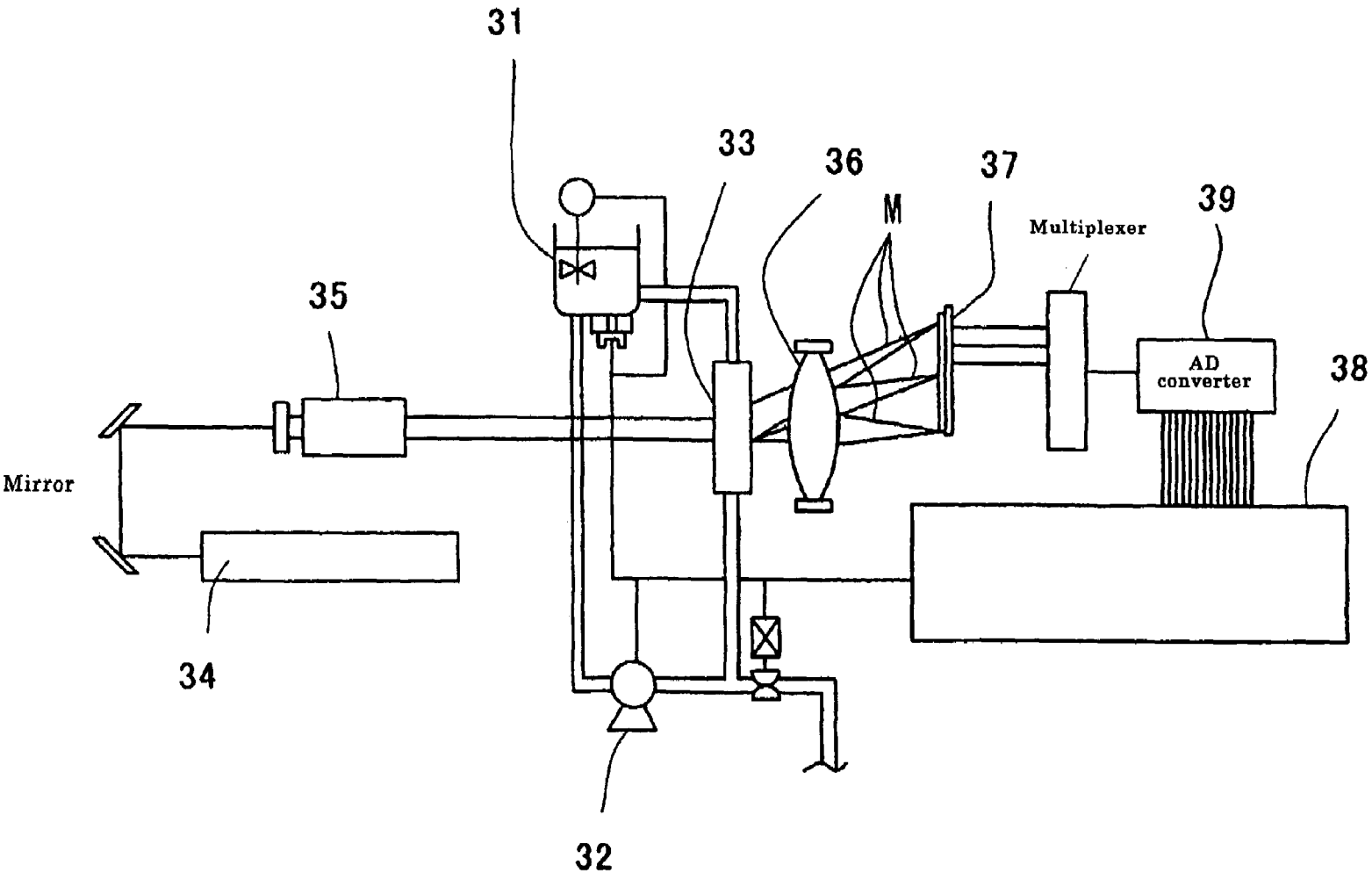
FIG. 6 is a schematic diagram explanatory of the measuring principle of a laser diffraction/scatter particle size distribution measuring instrument.

The volumetric mean particle size of the carrier can be measured by using a laser diffraction/scatter particle size distribution measuring instrument (for example, LA-500 manufactured by HORIBA, Ltd.) as shown in FIG. 6. After weighing 10 g of specimen, the specimen is put little by little into a sample holder containing 100 ml of methanol as a medium, while stirring. The sample solution is caused to flow into a laser irradiation chamber 33 by a circulation pump 32 while stirring and dispersing the sample solution in an ultrasonic dispersion bath 31. Laser beam emitted by a He—Ne laser 34 is spread by a beam spreader 35 and directed into the laser irradiation chamber 33. Then diffracted light ray M is focused by a collector lens 36 onto a detector 37 where it is detected. Detected signal is processed by an AD converter 39, then by an arithmetic operation unit 38 that calculates the particle size distribution.

Saturation magnetization of the carrier is measured by means of a vibrating sample magnetometer (model VSM-P7-15 manufactured by TOEI INDUSTRY CO., LTD.). An exclusive container filled with the specimen is weighed and set on a sample holder, and saturation magnetization is measured in the applied magnetic field of $3.98\times10^5$ A/m.

When scraping the residual toner, that has not been used in development process, off the developing roller by means of the magnetic brush of the developing agent formed on the magnetic roller, it is effective to increase the scraping force by using a carrier having a higher magnetic flux density. In the developing device of the present invention, however, it is preferable to use a carrier having low magnetic flux density, namely a carrier having saturation magnetization in the range described above, in order to remove the residual toner from the developing roller, deposit fresh toner that is sufficiently charged onto the developing roller, and form a uniform and thin toner layer on the developing roller. Use of the carrier having low magnetic flux density makes it possible to form a soft magnetic brush so as to form a uniform and thin toner layer on the developing roller. When a carrier having a higher saturation magnetization is used, on the other hand, it becomes difficult to separate the carrier from the magnetic roller resulting in such a defect as the pitch pattern of proximate stirring-transfer means (such as paddle mixer) appears in the picture. Such an unevenness caused in mixing (pitch pattern) can be eliminated by using the carrier having low saturation magnetization which reduces the magnetic restrictive force and makes it easier to separate the carrier from the magnetic roller.

The greatest problem of the carrier having low magnetic flux density, namely sticking of the carrier, can be solved by employing the hybrid developing system where the toner is transferred from the magnetic brush formed on the magnetic roller onto the developing roller so as to form a thin toner layer on the developing roller, while the toner flies to the photosensitive body, since in this case the carrier does not fly to the photosensitive body even when a small amount of the carrier from the magnetic roller deposits on the developing roller. In other words, it is known that sticking of the carrier occurs in an area of the same color when the carrier has a low resistivity. According to the present invention, volume resistivity of the carrier is set to a value from about $10^8$ to $10^{12}$ Ω·cm and a gap is provided between the developing roller and the photosensitive body, so that only the toner from the magnetic roller is caused to deposit on the developing roller and the carrier does not deposit on the developing roller, thereby causing only the toner to fly. Should a small amount of the carrier moves from the magnetic roller to the developing roller and deposits thereon, the carrier does not fly toward the photosensitive body but returns to the magnetic roller. As a result, it is not necessary to provide a constitution for replenishing the developing agent or recover the sticking carrier since depletion of the developing agent does not occur.

The carrier having a low magnetic flux density can be manufactured by increasing an impurity of ferrite carrier, while a composition that includes Sn has been recently proposed as described in Japanese Unexamined Patent Publication (Kokai) No. 11-202559. A carrier having saturation magnetization of 35 emu/g or less includes a higher concentration of impurity that makes it necessary to set the firing conditions to tight tolerance, and therefore sufficient ferrite reaction cannot be achieved. As a result, the carrier tends to have rough surface which leads to such problems as volume production becomes unstable when the carrier surface is covered with a coating material, and variability in the electric resistance that makes it inappropriate for practical use.

The non-magnetic toner in the present invention is composed of a binder resin and a coloring agent. As the binder resin, for example, there may be used thermoplastic resins such as polystyrene-based resin, acryl-based resin, styrene-acryl-based copolymer, polyethylene-based resin, polypropylene-based resin, polyvinyl chloride-based resin, polyester-based resin, polyamide-based resin, polyurethane-based resin, polyvinyl alcohol-based resin, vinyl ether-based resin, N-vinyl-based resin and styrene-butadiene resin.

Examples of the coloring agent include, but are not limited to, black, magenta, cyan and yellow pigments. These coloring agents are usually added in the amount in a range from 2 to 20 parts by weight, and preferably from 5 to 15 parts by weight, based on 100 parts by weight of the binder resin.

Examples of the black coloring agent include carbon blacks such as acetylene black, lamp black and aniline black.

Examples of the magenta coloring agent include C.I. Pigment Red 81, C.I. Pigment Red 122, C.I. Pigment Red 57, C.I Pigment Red 49, C.I. Solvent Red 49, C.I. Solvent Red 19, C.I. Solvent Red 52, C.I. Basic Red 10, C.I. Disperse Red 15 described in color index.

Examples of the cyan coloring agent include C.I. Pigment Blue 15, C.I. Pigment Blue 15-1, C.I. Pigment Blue 16, C.I. Solvent Blue 55, C.I. Solvent Blue 70, C.I. Direct Blue 86 and C.I. Direct Blue 25 described in color index.

Examples of the yellow coloring agent include nitro-based pigments such as Naphthol Yellow S; azo-based pigments such as Hanza Yellow 5G, Hanza Yellow 3G, Hanza Yellow G, Benzidine Yellow G and Vulcan Fast Yellow 5G; and inorganic pigments such as yellow iron oxide and yellow ocher. Specific examples thereof include C.I. Pigment Yellow 12, C.I. Pigment Yellow 180, C.I. Solvent Yellow 2, C.I. Solvent Yellow 6, C.I. Solvent Yellow 14, C.I. Solvent Yellow 15, C.I. Solvent Yellow 16, C.I. Solvent Yellow 19 and C.I. Solvent Yellow 21 described in color index.

As far as the effects of the present invention are not adversely affected, other additives may be added. Examples of the additive include charge control agent and wax. As the charge control agent, known charge control agents can be used. As the positively charged charge control agent, for example, there can be used nigrosine dye, fatty acid-modified nigrosine dye, carboxyl group-containing fatty acid-modified nigrosine dye, quaternary ammonium salt, amine-based compound and organometallic compound. As the negatively charged charge control agent, for example, there can be used metal complex of oxycarboxylic acid, metal complex of azo compound, metal complex salt dye and salicylic acid derivative. Examples of the wax include olefin-based waxes such as synthetic polyethylene wax and synthetic polypropylene wax; plant-based waxes such as carnauba wax, rice wax and candelilla wax; mineral-based waxes such as montan wax; petroleum-based waxes such as paraffin wax and microcrystalline wax; ester-based waxes; and Teflon®-based waxes.

If necessary, external additives such as inorganic oxide may be added to the toner. As the external additive, for example, there can be used alumina, titanium oxide, zinc oxide, magnesium oxide, silicon oxide and strontium titanate. Volumetric mean particle size of the external additive is in a range from 0.001 to 1.0 μm, preferably from 0.005 to 0.3 μm. Quantity of the external additive is preferably in a range from 0.1 to 2.0 parts by weight for 100 parts by weight of the toner. The external additive and the toner can be mixed using a Henschel mixer, type V mixer, Turbula mixer, hybridizer or the like.

A method for manufacturing the toner of the present invention will now be described. A predetermined quantity of colorant and, as required, wax, charge control agent, charge regulating resin and the like are added to a binder resin, and are mixed in the Henschel mixer or the like. The mixture is melted and kneaded in a biaxial extruding machine or the like, cooled in a drum flaker or the like and is subjected to coarse crushing by a hammer mill or the like. The crushed material is then pulverized into a fine powder by a whirl mill or the like. The powder is classified by a wind classifier or the like so as to obtain the toner whose volumetric mean particle size is in a range from 6 to 11 μm and where proportion of toner particles not larger than 4 μm is 8% by number or less. The toner thus obtained may also include the predetermined quantity of the external additive added as required.

In the magnetic carrier of the present invention, there can be used magnetic particles produced by sintering and atomizing magnetic materials, for example, magnetic metals such as iron, nickel and cobalt, and alloys thereof, or alloys containing rare earth elements; soft ferrites such as hematite, magnetite, manganese-zinc-based ferrite, nickel-zinc-based ferrite, manganese-magnesium-based ferrite and lithium-based ferrite; iron-based oxides such as copper-zinc-based ferrite; and mixtures thereof. The surface of the magnetic particles may be coated with resins such as styrene-acryl resin, acryl resin, styrene resin, silicone resin, acryl-modified silicone resin and fluororesin. As the above carrier, a magnetic material dispersed resin can also be used. In this case, the above magnetic materials can be used as the magnetic material. Examples of the binder resin include vinyl-based resin, polyester resin, epoxy resin, phenol resin, urea resin, polyurethane resin, polyimide resin, cellulose resin, polyether resin and mixtures thereof.

Toner concentration in the two-component developing agent is in a range from 1 to 20% by weight, preferably from 3 to 15% by weight. Toner concentration lower than 1% by weight may lead to unacceptably low image density. Toner concentration higher than 20% by weight, on the other hand, may lead to such problems as contamination in the machine and undesired deposition of the toner on the paper in the background of the image due to scatter of the toner in the developing device.

Figure 1:
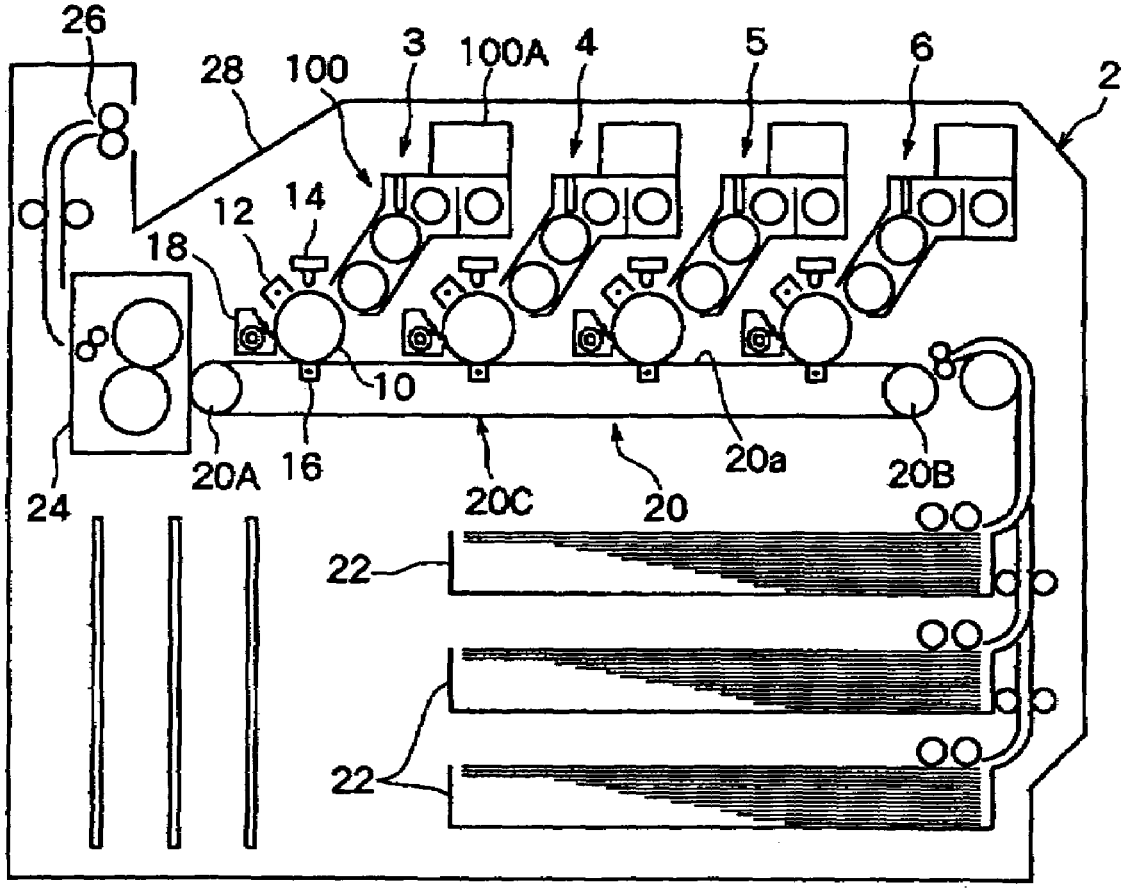
FIG. 1 is a schematic diagram of a tandem engine color image forming apparatus according to one embodiment of the present invention.

FIG. 1 is a schematic sectional view of the tandem engine color image forming apparatus provided with the developing device of vertical construction according to one embodiment of the present invention.

The image forming apparatus 2 includes black imaging means 3, cyan imaging means 4, magenta imaging means 5 and yellow imaging means 6 that are disposed therein in this order from left to right in a horizontal direction in FIG. 1. Each of these imaging means 3, 4, 5 and 6 has such imaging elements as a photosensitive drum 10, an electrostatic charger 12, an exposure device (more specifically a semiconductor laser or LED head constituting a part of the exposure device) 14, a developing device 100 to be described in detail later, an image transfer device 16 and a cleaning device 18. In FIG. 1, reference numerals of the imaging elements are indicated only for the black imaging means 3 for the sake of simplicity. The developing device 100 of each of the imaging means 3, 4, 5 and 6 has a toner container 100A that supplies the toner of the corresponding color.

Disposed below the imaging means 3, 4, 5 and 6 is a transfer belt mechanism 20. The transfer belt mechanism 20 comprises a drive roller 20A, a driven roller 20B and an endless transfer belt 20C that is stretched to run around the drive roller 20A and the driven roller 20B. Top surface 20*a* of the transfer belt 20C extends substantially horizontally so as to run between the photosensitive drums 10 and the image transfer device 16 in the imaging means 3, 4, 5 and 6, and forms a transfer surface for recording paper. The transfer belt 20C is driven by the drive roller 20A and the driven roller 20B to run counterclockwise in FIG. 1 (See arrow mark in FIG. 2).

Disposed below the transfer belt mechanism 20 is a paper feed cassette 22. Disposed downstream of the transfer belt mechanism 20 are a fixing device 24, a paper discharge roller 26 and a copied paper tray 28. A sheet of paper supplied from the paper feed cassette 22 is transferred by the transfer belt mechanism 20 to run between the photosensitive drum 10 and the image transfer device 16. The paper receives the toners of the colors, that correspond to those of the picture deposited successively thereon and are fixed by the fixing device 24, before the paper is discharged by the discharge roller 26 onto the copied paper tray 28.

The imaging means 3, 4, 5 and 6 including the developing device 100 provided in the tandem engine color image forming apparatus will now be described in detail. The imaging means 3, 4, 5 and 6 have substantially identical constitutions, and will therefore be represented by the black imaging means 3 in the description that follows.

Figure 2:
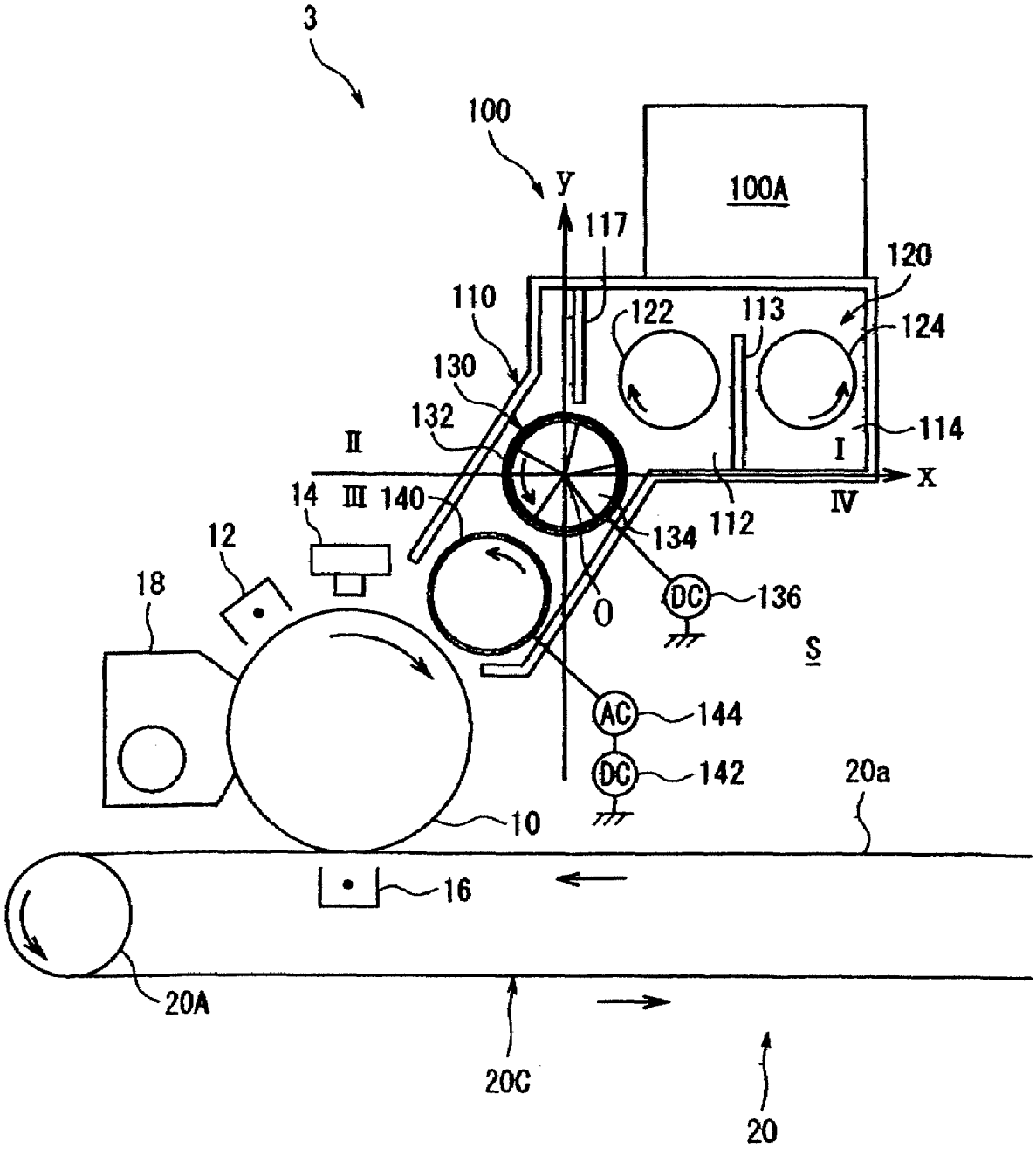
FIG. 2 is a schematic diagram showing black imaging means provided in the tandem engine color image forming apparatus shown in FIG. 1.
Figure 3:
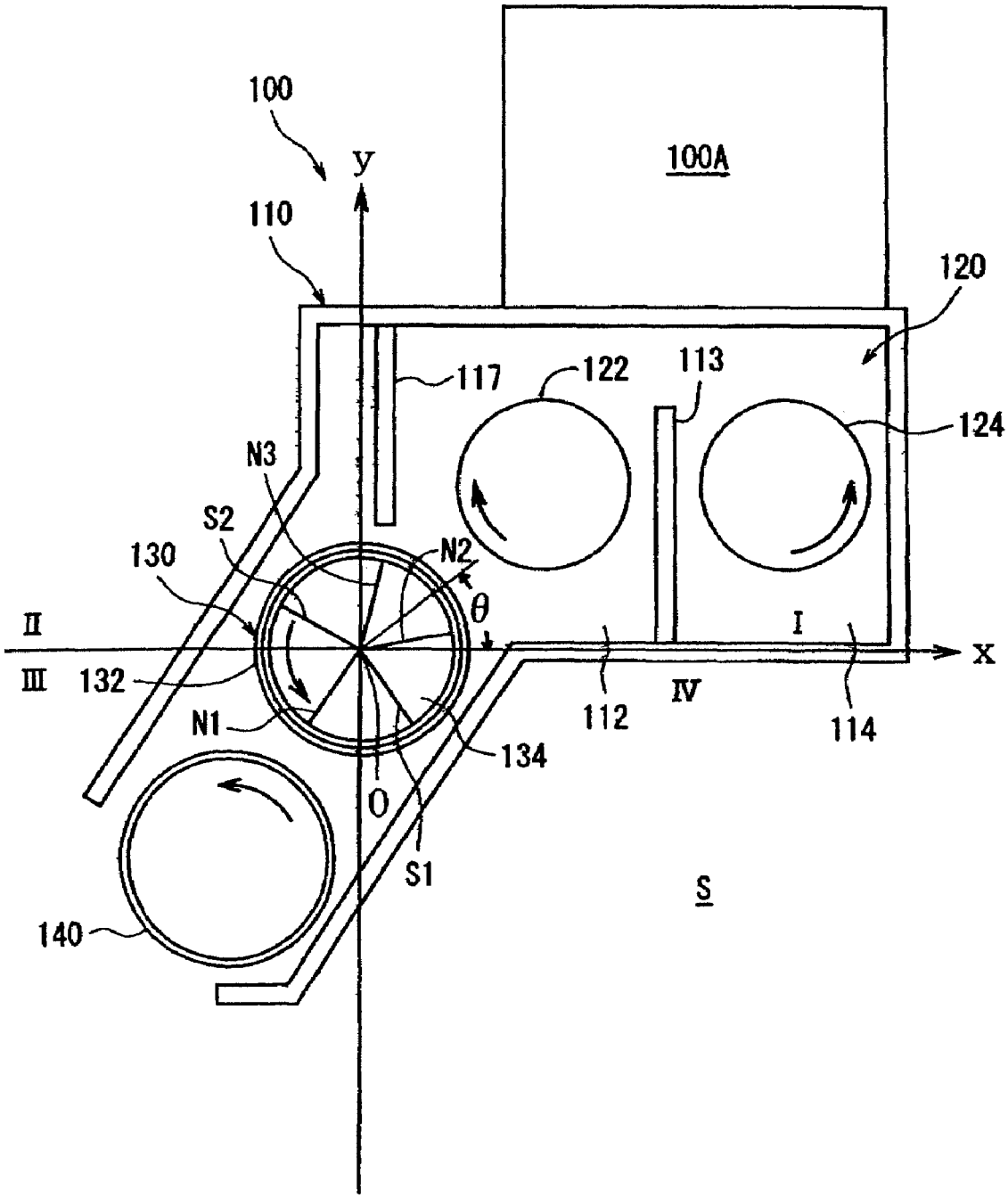
FIG. 3 is a schematic diagram showing a developing device provided in the black imaging means shown in FIG. 2.

As shown in FIG. 2 and FIG. 3, the imaging means 3 has imaging elements such as the photosensitive drum 10, the electrostatic charger 12, the exposure device 14, the developing device 100, the image transfer device 16 and the cleaning device 18. For the tandem engine image forming apparatus, it is important to design the imaging elements in compact construction. The imaging elements such as the electrostatic charger 12, the exposure device 14, the developing device 100, the image transfer device 16 and the cleaning device 18 are disposed around the photosensitive drum 10. For this reason, the developing device 100 is designed in substantially vertical construction.

A positively charged organic photosensitive material (positive OPC), a-si photosensitive material or the like may be used as the photosensitive material of the photosensitive drum 10. When the positive OPC is used, ozone is less likely to be generated and stable charging can be achieved. A positive OPC having single-layer structure, in particular, experiences less variation in the photosensitivity characteristic and provides stable picture quality even when the film thickness changes after being used over a long period of time, and is suitable for a system having a long service life. The positive OPC used in a system having a long service life is preferably formed in a film having thickness in a range from 20 to 40 μm. In the case of film thickness of less than 20 μm, when the film thickness decreases to about 10 μm, black spots will appear conspicuously due to insulation breakdown. When the film thickness is more than 40 μm, sensitivity decreases, thus making a cause of lower image density.

A semiconductor laser or LED head may be used for the exposure device 14. Use of the positive OPC as the photosensitive material is effective for wavelengths around 770 nm, and the a-si photosensitive material is effective for wavelengths around 685 nm. In the embodiment of the present invention, the positive OPC is used as the photosensitive material, and an LED head is used as the exposure device 14.

The developing device 100 of the present invention has a housing 110 that may be formed from a synthetic resin. The housing 110 is open at one end that opposes the photosensitive drum 10. Disposed within the housing 110 are the 2-component developing agent consisting of the magnetic carrier and the non-magnetic toner, a stirring-transfer means 120 that transfers the developing agent while stirring it, a magnetic roller 130 which transfers the developing agent while magnetically holding it on the circumferential surface thereof, and a developing roller 140 which is disposed to oppose the circumferential surfaces of the magnetic roller 130 and of the photosensitive drum 10 at predetermined spaces therefrom and attracts only the toner to deposit thereon electrostatically.

The magnetic roller 130 has a cylindrical magnetic sleeve 132 made of a non-magnetic material such as aluminum, and a stationary permanent magnet 134 comprising a plurality of magnetic poles N1, S1, N2, N3, S2 disposed in this order along the circumferential direction within the magnetic sleeve 132. The two-component developing agent is attracted by magnetism onto the circumferential surface of the magnetic sleeve 132 so as to form a magnetic brush, and the two-component developing agent is transferred by the rotating magnetic sleeve 132. The magnetic roller 130 receives a predetermined DC bias voltage applied thereto by a first DC power source 136.

The developing roller 140 comprises a cylindrical member (sleeve) made of an electrically conductive material. The material used to form the sleeve may be any uniform electrically conductive material, such as aluminum, stainless steel or one that is coated with an electrically conductive resin on the circumferential surface thereof. Surface resistivity of the sleeve is determined by taking into consideration the developing performance and leakage during development. Clearance between the circumferential surface of the developing roller 140 and the circumferential surface of the positive OPC is set to about 250 μm. Wire electrode or the like is not used in this space. The developing roller 140 receives a predetermined DC bias voltage applied thereto by a second DC power source 142, and an AC bias voltage superposed thereon by an AC power source 144.

Disposed in the housing 110 is a first developing agent stirring chamber 112 located adjacent to the magnetic roller 130 and a second developing agent stirring chamber 114 separated by a partition wall 113 from the first developing agent stirring chamber 112. The first and second developing agent stirring chambers 112, 114 communicate with each other at both ends of the magnetic roller 130 in the axial direction thereof, thereby forming an endless circulating transfer path as a whole. The circulating transfer path constitutes a development chamber within the housing 110. The first developing agent stirring chamber 112 extends straight along the magnetic roller 130. The second developing agent stirring chamber 114 extends straight in parallel to the first developing agent stirring chamber 112 with the partition wall 113 interposed therebetween.

The stirring-transfer means 120 comprises a first rotary spiral blade member 122 and a second rotary spiral blade member 124. The first rotary spiral blade member 122 is disposed freely rotatably within the first developing agent stirring chamber 112 so as to extend straight along the first developing agent stirring chamber 112 and the magnetic roller 130, while the second rotary spiral blade member 124 is disposed freely rotatably within the second developing agent stirring chamber 114 so as to extend straight along the second developing agent stirring chamber 114. Also installed in the housing 110 is a layer thickness regulating blade 117 that regulates the thickness of the developing agent layer held on the circumferential surface of the magnetic roller 130.

The developing device 100 has such a constitution as the first rotary spiral blade member 122 and the second rotary spiral blade member 124 are disposed in the first quadrant and the developing roller 140 is disposed in the third quadrant of an orthogonal coordinate system (plane orthogonal coordinate system consisting of x axis and y axis) having the origin at the center O of rotation of the magnetic roller 130 (namely the center O of rotation of the magnetic sleeve 132). The first rotary spiral blade member 122 and the second rotary spiral blade member 124 are disposed in parallel in substantially horizontal direction. Accordingly, the first developing agent stirring chamber 112 and the second developing agent stirring chamber 114 are disposed in parallel in substantially horizontal direction within the first quadrant.

Below the housing 110 (between the bottom surface of the housing 110 and the travel surface 20*a* on the upper side of the belt mechanism 20), a space region S is formed within the fourth quadrant or across the fourth and third quadrants. In this embodiment, the region S is formed across the fourth and third quadrants. The photosensitive drum 10, the electrostatic charger 12, the LED head 14, the image transfer device 16 and the cleaning device 18 are disposed within the third quadrant.

Figure 4:
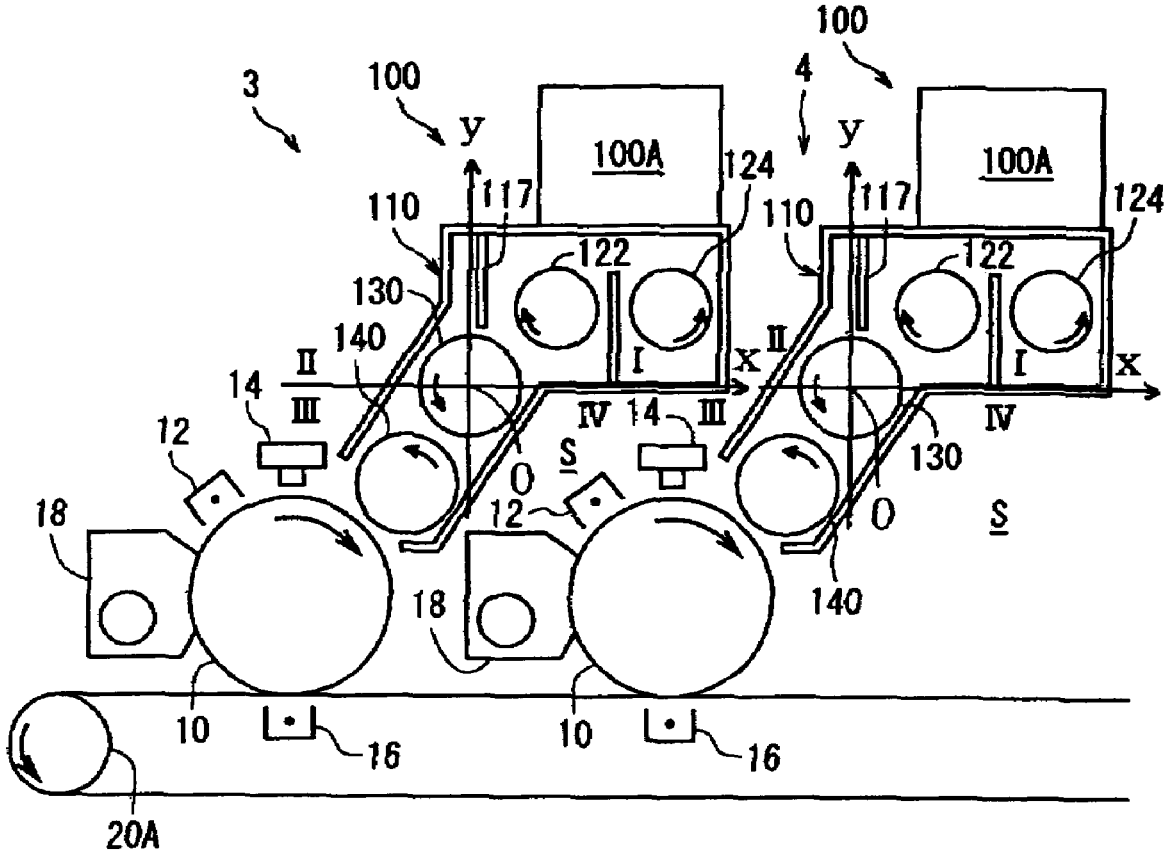
FIG. 4 is a schematic diagram showing the black imaging means and cyan imaging means provided in the tandem engine color image forming apparatus shown in FIG. 1.

Vertical construction of the developing device 100 as described above makes it possible to form the space region S below the developing device 100, thereby greatly contributing to the size reduction of the image forming apparatus. That is, as shown in FIG. 1 and FIG. 4, the photosensitive drum 10, the electrostatic charger 12, the LED head 14, the image transfer device 16 and the cleaning device 18 of the cyan imaging means 4 are disposed in the space region S formed below the developing device 100 of the adjacent black imaging means 3. Similarly, the photosensitive drum 10, the electrostatic charger 12, the LED head 14, the image transfer device 16 and the cleaning device 18 of the magenta imaging means 5 are disposed in the space region S formed below the developing device 100 of the adjacent cyan imaging means 4. Further, the photosensitive drum 10, the electrostatic charger 12, the LED head 14, the image transfer device 16 and the cleaning device 18 of the yellow imaging means 6 are disposed in the space region S formed below the developing device 100 of the adjacent magenta imaging means 5. Since this construction makes it possible to dispose in the horizontal direction the imaging means 3, 4, 5 and 6 having the developing devices 100 of vertical construction and use space as effectively as possible, the tandem engine color image forming apparatus can be formed in a compact construction with minimum lateral and longitudinal dimensions.

In the imaging means 3, 4, 5 and 6, the toner container 100A may be disposed on top of the developing device 100, namely on top of the housing 110. This configuration enables free fall through a toner replenishing port by the toner stirring-transfer means, and makes it possible to remove the toner container through the top of the image forming apparatus 2 and install it thereon from above for replacement. In addition to the toner container 10A, the developing device 100 can also be removed through the top of the image forming apparatus 2 and installed thereon from above, thus making it easier to remove and install in the event of failure or for maintenance. Constitution of the developing device 100 can also be simplified as a whole.

As shown in FIG. 3, the stationary permanent magnet 134 has such a constitution as the plurality of magnetic poles N1, S1, N2, N3, S2 disposed in this order along the circumferential direction. The magnetic poles N2 and N3 constitute a pair of poles of the same polarity (repulsing poles). That is, the stationary permanent magnet 134 comprises the magnetic pole N1, the clipping magnetic pole N3, the transfer magnetic pole S2, the transfer magnetic pole S1 and the transfer magnetic pole N2. The magnetic pole N1 is located at the most proximate position to the developing roller 140. The clipping magnetic pole N3 is located in a region where the two-component developing agent that has been stirred and transferred by the first rotary spiral blade member 122 is received and clipped by the layer thickness regulating blade 117. The layer thickness regulating blade 117 regulates the magnetic brush formed on the circumferential surface of the magnetic sleeve 132. The transfer magnetic pole S2 transfers the magnetic brush that has been clipped to the most proximate magnetic pole N1. The transfer magnetic pole S1 receives the magnetic brush from the most proximate magnetic pole N1. The transfer magnetic pole N2 receives the magnetic brush from the transfer magnetic pole S1 and transfers it into the first developing agent stirring chamber 112.

According to the present invention, it is preferable to locate a region where perpendicular magnetization has the lowest value (hereinafter referred to as minimum magnetic force region). The perpendicular magnetization is formed between the pair of magnetic poles N2 and N3 of the same polarity by the repulsing magnetic force of the pair of magnetic poles of the same polarity (repulsing poles). The minimum magnetic force region is preferably located within a range of angles θ from 35 to 60 degrees in the first quadrant. The angle θ in the first quadrant refers to the angle between the straight line connecting the minimum magnetic force region and the origin O, and the x axis. Needless to say, perpendicular magnetization of the minimum magnetic force region varies, depending on the constitution of the developing device 100 (diameter of the magnetic roller 130, layout of the stationary permanent magnet 134, magnetic flux density of the stationary permanent magnet 134, etc,). While the magnetic flux density may be, for example, within 1 mT (millitesla) or within 3 mT, it is preferably 0 tesla or near 0 tesla.

The photosensitive drum 10, the developing roller 140 of the developing device 100, the magnetic roller 130, the first rotary spiral blade member 122 and the second rotary spiral blade member 124 are driven by driving means that are not shown, to rotate in the directions of arrows in FIGS. 2 and 3. The positive OPC that is an electrostatic latent image carrier is charged at 400 V by the electrostatic charger 12. Then as exposure is carried out with the LED head at wavelength of 770 nm, potential of the photosensitive material after maximum exposure becomes 70 V. The toner is charged to a proper level by driving and rotating the first and second rotary spiral blade members 122 and 124 thereby stirring the developing agent.

The two-component developing agent within the first developing agent stirring chamber 112 is held on the circumferential surface of the magnetic sleeve 132. The developing agent held on the circumferential surface of the magnetic sleeve 132 is formed into a layer of a predetermined thickness by passing the layer thickness regulating blade 117 over it. Thus the developing agent held on the circumferential surface of the magnetic sleeve 132 touches the circumferential surface of the developing roller 140 as a layer of constant thickness. The magnetic sleeve 132 is under a predetermined DC bias voltage V1 applied thereto by the first DC power source 136, and the developing roller 140 is under a predetermined DC bias voltage V2 applied thereto by the second DC power source 142. Therefore, a thin layer is formed on the circumferential surface of the developing roller 140 solely from the toner attracted thereto by the potential difference V1-V2 between the magnetic sleeve 132 and the developing roller 140. A toner layer of about 1.0 to 1.5 mg/cm$^2$ is formed on the circumferential surface of the developing roller 140 by setting the DC bias voltage V1 of the magnetic sleeve 132 to 400 V and setting the DC bias voltage V2 of the developing roller 140 to a level of 100 to 150 V. At this time, proper level of charging the developing agent is from about 10 to 20 μC/g. When the charge is less than 10 μC/g, the toner scatters conspicuously. When the charge is more than 20 μC/g, the toner that forms the thin layer is difficult to fly to the circumferential surface of the photosensitive drum 10.

The toner deposited on the circumferential surface of the developing roller 140 can be caused to fly to the electrostatic latent image formed on the circumferential surface of the photosensitive drum 10 and effect development, by applying the bias voltage comprising DC voltage and AC voltage to the developing roller 140. In order to prevent the toner from scattering, the AC bias voltage is applied to the developing roller 140 immediately before the development process. Specifically, the predetermined AC bias voltage is applied to the developing roller 140 by the AC power source 144 immediately before the development process, so as to superpose on the predetermined DC bias voltage V2 that has been applied to the developing roller, 140 by the second DC power source 142. Balancing of the image density, reproduction of dots and removal of fog can be achieved by setting the AC bias voltage Vp-p (peak-to-peak voltage) to 1.5 kV and frequency f to 3.0 KHz. Development ghost can be suppressed by setting the duty ratio to 30%.

Measurement of the potential of the toner layer on the developing roller 140 across the surface shows about 320 V, indicating that development is effectively carried out by a voltage of 250 V, that is 320 V-70 V (voltage of photosensitive material after maximum exposure). The gap between the circumferential surface of the magnetic sleeve 132 and the circumferential surface of the developing roller 140 is set to 400 μm. While the gap between the layer thickness regulating blade 117 and the circumferential surface of the magnetic sleeve 132 is controlled in accordance to the particle size of the magnetic carrier, for example, when the two-component developing agent consisting of the magnetic carrier having volumetric mean particle size of 35 μm and 10% non-magnetic toner is used, the gap is set to a value between 400 to 500 μm so that the magnetic brush makes contact with the circumferential surface of the developing roller 140. When the gap between the circumferential surface of the magnetic sleeve 132 and the circumferential surface of the developing roller 140 is too small, the two-component developing agent cannot pass through the gap between the magnetic sleeve 132 and the developing roller 140 and overflows. When the gap is too large, on the other hand, the two-component developing agent cannot make contact with the circumferential surface of the developing roller 140, making it difficult to recover the toner from the developing roller 140. When the development operations are repeated under this condition, the toner sticks to the circumferential surface of the developing roller 140 and cannot fly to the photosensitive drum 10. These problems can be alleviated by setting the gap to a value between 400 to 500 μm.

Since the layer thickness regulating blade 117 made of a magnetic material is disposed so as to substantially oppose, at an outside position in the radial direction, the clipping magnetic pole N3 disposed on the stationary permanent magnet 134 of the magnetic roller 130, magnetic field is formed in the space between the magnetic roller 130 and the layer thickness regulating blade 117. By controlling the transfer property of the magnetic brush formed on the circumferential surface of the magnetic sleeve 132 and applying knurling or sand blast treatment to the surface of the magnetic sleeve 132 so as to increase the transfer performance in this constitution, it is made possible to relax the gap margin between the magnetic sleeve 132 and the layer thickness regulating blade 117.

The two-component developing agent contained in the first rotary spiral blade member 112 is sucked up through adsorption by the circumferential surface of the rotating magnetic sleeve 132, thereby forming the magnetic brush. As the magnetic brush that has passed through the space between the magnetic sleeve 132 and the layer thickness regulating blade 117 passes along the developing roller 140, only the non-magnetic toner is supplied to the developing roller 140. The magnetic brush, from which only the non-magnetic toner is supplied to the developing roller 140, is transferred into the first developing agent stirring chamber 112 while being adsorbed onto the circumferential surface of the magnetic sleeve 132, before being removed from the circumferential surface of the magnetic sleeve 132 and returning into the first developing agent stirring chamber 112. The two-component developing agent that has returned into the first developing agent stirring chamber 112 is transferred while being stirred together with other two-component developing agent by the first and second rotary spiral blade members 122 and 124 along the first developing agent stirring chamber 112 and the second developing agent stirring chamber 114, respectively. When there is shortage in the quantity of the toner in the developing chamber, the toner is replenished from the toner container 100A by the known manner. This process needs to be repeated in order to copy a color image on a number of sheets of paper.

In order to remove the magnetic brush from the circumferential surface of the magnetic sleeve 132, it is the easiest way to remove it downward (in the direction of gravity). However, this results in laterally longer construction of the developing device 100 which compromises the size reduction of the image forming apparatus and is not desirable. As described previously, in the developing device 100 of this embodiment, for the purpose of size reduction of the image forming apparatus, the first and second rotary spiral blade members 122 and 124 are disposed in the first quadrant and the developing roller 140 is disposed within the third quadrant. For this reason, it is necessary to lift and remove the magnetic brush from which only the toner has been supplied to the developing roller 140 in the magnetic sleeve 132, from below to a position above the horizontal position on the circumferential surface of the magnetic sleeve 132, specifically from the third quadrant and the fourth quadrant up to the first quadrant.

The magnetic brush may be removed from the circumferential surface of the magnetic sleeve 132 by disposing the permanent magnets of the same polarity stationary inside, and forming the minimum magnetic force region described above. When the magnetic brush is lifted to the horizontal position, however, even if the minimum magnetic force region generated by the repulsive magnetic force exists, if the minimum magnetic force region is near the horizontal position, the magnetic brush does not fully return to the developing chamber (the first developing agent stirring chamber 112), and a part of the magnetic brush, namely the magnetic carrier and/or non-magnetic toner, leaks from the developing chamber downward (into the fourth quadrant). When the minimum magnetic force region is disposed at a position near the second quadrant, in contrast, the magnetic brush cannot be fully removed but passes through the gap between the circumferential surface of the magnetic sleeve 132 and the layer thickness regulating blade 117, thus resulting in an undesirable state of separation failure where the same magnetic brush continues to remain on the circumferential surface of the magnetic sleeve 132. In the event of separation failure, the image density significantly decreases after developing on merely several sheets of paper.

According to the present invention, the region where least perpendicular magnetization is the lowest, namely the minimum magnetic force region, is formed between the pair of magnetic poles N2 and N3 of the same polarity by the repulsing magnetic force of the pair of magnetic poles of the same polarity in the stationary permanent magnet 134 incorporated in the magnetic roller 130. By locating the minimum magnetic force region within a range of angles from 35 to 60 degrees in the first quadrant, two problems of the separation failure of the developing agent and the leakage from the developing chamber downward (into the fourth quadrant) as described above can be solved simultaneously. Specifically, in the development process, the magnetic brush from which only the non-magnetic toner is supplied to the developing roller 140, is transferred into the first developing agent stirring chamber 112 while being adsorbed onto the circumferential surface of the magnetic sleeve 132, before being removed from the circumferential surface of the magnetic sleeve 132 in the region of 0 tesla and returning into the first developing agent stirring chamber 112. Since the minimum magnetic flux density region is located within a range of angles from 35 to 60 degrees in the first quadrant, the magnetic brush can surely return to the developing chamber (the first developing agent stirring chamber 112), thus avoiding the leakage of a part of the magnetic brush, namely the magnetic carrier and/or non-magnetic toner, from the developing chamber downward (into the fourth quadrant). Also because the magnetic brush is removed while being adsorbed onto the circumferential surface of the magnetic sleeve 132 and passing through the region of angles from 35 to 60 degrees in the first quadrant, the problem of separation failure where the same magnetic brush passes through the gap between the circumferential surface of the magnetic sleeve 132 and the layer thickness regulating blade 117 and continues to remain on the circumferential surface of the magnetic sleeve 132 is also solved.

Though the pair of magnetic poles N2 and N3 of the same polarity are disposed in the first quadrant in the embodiment shown, the invention is not limited to this constitution. What is important is to locate the minimum magnetic force region that is formed between the pair of magnetic poles N2 and N3, within a range of angles from 35 to 60 degrees in the first quadrant, and the position of the pair of magnetic poles N2 and N3 along the circumference may be determined in accordance to the specific developing device.

Examples and Comparative Examples of the present invention will now be described. It is understood, however, that the examples are for the purpose of illustration and the invention is not to be regarded as limited to any of the specific materials or condition therein.

EXAMPLES

A carrier having mean particle size and saturation magnetization of values shown in Table 1 and 10% by weight of toner having volumetric mean particle size of value shown in Table 1 were mixed in a ball mill, thereby to obtain the two-component developing agents. Formation of images was experimented by using these developing agents. Specifications of the toner and the carrier used in the experiment, an apparatus used in the evaluation and the evaluation method will be described below. Results of the experiment are shown in Table 1.

<Method of Preparing Toner>

Specifications of the toner and the carrier used in the experiment are as follows. "Parts" are by weight unless otherwise specified.

(Preparation of Binder Resin)

4.0 mol of polyoxypropylene(2.2)-2,2-bis(4-hydroxyphenyl)propane, 1.0 mol of polyoxyethylene(2.2)-2,2-bis(4-hydroxyphenyl)propane, 4.5 mol of terephthalic acid, 0.5 mol of trimellitic anhydride and 4 g of dibutyltin oxide were reacted under a nitrogen atmosphere at 230° C. over 8 hours to obtain a polyester resin having a softening point of 120° C.

(Formulation)

Polyester resin made as described above: 100 parts Carnauba wax (Product code C1, manufactured by S. KATO & CO.): 10 parts Carbon black (Product code MA100, manufactured by Mitsubishi Chemical Corporation): 4 parts Class 4 ammonium salt (Product code FCA201PS, manufactured by FUJIKURAKASEI CO., LTD.): 3 parts The materials were mixed in the composition described above in a Henschel mixer and melted and kneaded in a roll mill, before being cooled and crushed into a fine powder by a jet mill. The fine powder was classified under varying classifying conditions to obtain the toner particles. When toner having the desired particle size distribution could not be obtained in a single run of classification, the desired toner particles were obtained by repeating the classification. The toner was mixed with external additives shown below in the Henschel mixer for 4 minutes to obtain toner samples Nos. 1 through 10.

Toner: 100 parts

Fine particles of hydrophobic silica: 1.0 part

Fine particles of titanium oxide (Product code CR-EL, manufactured by ISHIHARA SANGYO KAISHA, LTD.): 0.5 parts The fine particles of hydrophobic silica were prepared by the following process.

RA-200H manufactured by Nippon Aerosil Co., Ltd. was crushed and conditioned using a jet mill model IDS-2 manufactured by Nippon Pneumatic Mfg. Co., Ltd. to obtain a desired specific surface area. 100 Parts by weight of the fine particles of silica were put into a closed Henschel mixer where 20 parts by weight of a hydrophobicity treatment agent consisting of γ-aminopropyl-triethoxylan and dimethyl-silicone oil mixed in equal proportions was sprayed uniformly from above, and hydrophobicity treatment was carried out while mixing at 110° C. for 2 hours. Then after removing the byproducts by reducing the pressure, the material was heated at 200° C. for 1 hour to obtain the desired silica.

The developing agent was made by mixing a resin-coated ferrite carrier (having properties of the samples Nos. 1 through 10) manufactured by PowderTech Corporation and 10% of the toner obtained as described above for 30 minutes in a ball mill. Evaluation test was conducted with a printer FS-C5016N manufactured by Kyocera Corporation using the toner that has been obtained.

<Evaluation Method>

Figure 5:
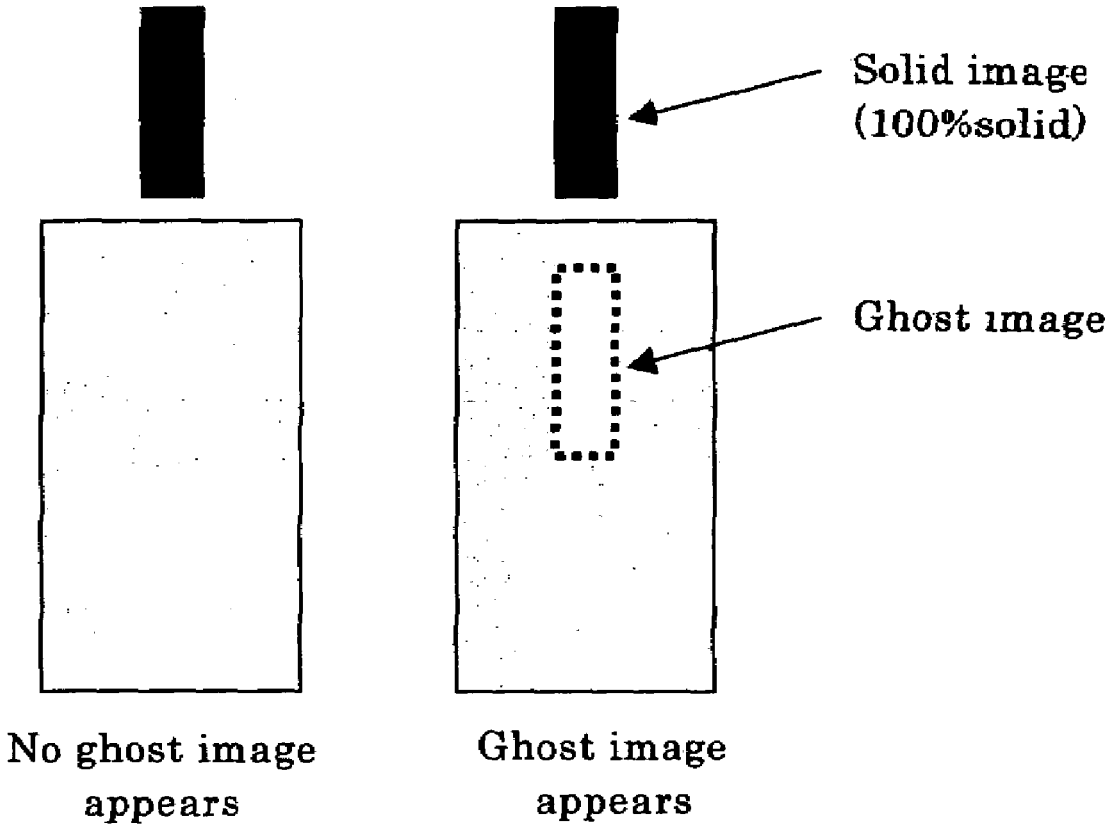
FIG. 5 is a schematic diagram showing an imaging defect (ghost) that may appear during development.

(1) Development ghost: The image shown in FIG. 5 was printed and hysteresis of the image was checked by visual inspection.

○: No hysteresis

Δ: Some hysteresis in the second round.

X: Hysteresis on the second and subsequent sheets of paper.

(2) 1-dot reproducibility: Each dot and 1-dot line were observed under a loupe having magnification power of 10, and rated with "○" when the dots are reproduced satisfactorily, and "X" when the reproduction was not satisfactory.

TABLE 1

| | Carrier | | Toner | | | |
|---|---|---|---|---|---|---|
| Sample No. | Volumetric mean particle size μm | Saturation magnetization emu/g | Volumetric mean particle size μm | Development ghost | 1 dot reproducibility | Others |
| 1 | 35 | 40 | 9 | ○ | ○ | |
| 2 | 35 | 40 | 9 | ○ | ○ | |
| 3 | 50 | 50 | 10 | ○ | ○ | |
| 4 | 50 | 50 | 11 | ○ | ○ | |
| 5 | 45 | 40 | 6 | ○ | ○ | |
| 6 | 45 | 35 | 9 | ○ | ○ | |
| 7 | 35 | 40 | 9 | x | ○ | |
| 8 | 45 | 40 | 6 | x | ○ | |
| 9 | 50 | 50 | 14 | ○ | x | |
| 10 | 45 | 40 | 5 | ○ | ○ | Low initial image density |

As shown in Table 1, the samples Nos. 7 through 9 showed development ghost or poor 1-dot reproducibility. In the samples Nos. 1 through 6 and 10, in contrast, development ghost did not appear and the 1-dot reproducibility was satisfactory. These results of the experiment cannot be explained by the volumetric mean particle size or saturation magnetization of the carrier or the volumetric mean particle size of the toner.

The inventor of the present invention analyzed and found that the test results were caused by the toner sticking to the developing roller. Further analysis of the sticking toner showed that smaller particles of the toner, particularly toner particles 4 μm or smaller in size are more likely to stick to the developing roller.

Number proportions of particles measuring 4 μm or less in the toner samples Nos. 1 through 10 are shown in Table 2. Also shown in Table 2 are the results of evaluating the development ghost and 1-dot reproducibility similar to those shown in Table 1.

TABLE 2

| Sample No. | Proportion of toner particles not larger than 4 μm (%) | Development ghost | 1 dot reproducibility |
|---|---|---|---|
| 1 | 8 | ○ | ○ |
| 2 | 3 | ○ | ○ |
| 3 | 8 | ○ | ○ |
| 4 | 8 | ○ | ○ |
| 5 | 8 | ○ | ○ |
| 6 | 6 | ○ | ○ |
| 7 | 10 | x | ○ |
| 8 | 10 | x | ○ |
| 9 | 5 | ○ | x |
| 10 | 8 | ○ | ○ |

Through comparison of the number proportions of toner particles measuring 4 μm or less, development ghost and 1-dot reproducibility shown in Table 2, it was found that development ghost does not appear and the 1-dot reproducibility is satisfactory when the number proportions of toner particles measuring 4 μm or less is 8% or less.

In samples Nos. 7 and 8, where the number proportions of toner particles measuring 4 μm or less was 10%, scraping of the toner from the developing roller by the magnetic roller was not sufficient, thus resulting in development ghost.

Sample No. 9 showed scatter of much toner and significantly poor 1-dot reproducibility, because the toner had volumetric mean particle size of 14 μm (Table 1) and proportion of toner particles not larger than 4 μm was 5%.

Sample No. 10 showed a low image density such as the initial image density below 1.0 because the toner had volumetric mean particle size of 5 μm. This is because small particle size of the toner makes the toner difficult to fly from the developing roller to the photosensitive body.

From the test results described above, it can be seen that in the hybrid development system where the two-component developing agent consisting of the magnetic carrier and the non-magnetic toner is used, it is preferable that the non-magnetic toner has a volumetric mean particle size of 6 to 11 μm and proportion of toner particles not larger than 4 μm is 8% or less, in order to prevent imaging defect (ghost) and sticking of the toner onto the developing roller from occurring.

What is claimed is:

1. A developing device comprising:

stirring-transfer means which transfers a developing agent while stirring it;

a magnetic roller comprising a magnetic sleeve and a plurality of magnetic poles disposed along the circumferential direction within said magnetic sleeve for transferring said developing agent while holding it on the surface of said magnetic sleeve; and a developing roller disposed to oppose said magnetic roller at a predetermined space therefrom for attracting a toner included in the developing agent held on said magnetic roller so as to deposit electrostatically thereon, that are disposed in a housing which contains a two-component developing agent comprising a magnetic carrier and a non-magnetic toner, wherein said non-magnetic toner has a volumetric mean particle size in a range from 6 to 11 μm, and proportion of toner particles not larger than 4 μm is 8% by number or less, and said magnetic carrier has saturation magnetization in a range from 35 to 50 emu/g and volumetric mean particle size in a range from 35 to 50 μm.

2. The developing device as described in claim 1, wherein the carrier has volume resistivity in a range from $10^8$ to $10^{12}$ Ω·cm.

3. The developing device as described in claim 1, wherein said non-magnetic toner comprises a binder resin, a coloring agent, a charge control agent and wax, and has an external additive selected from aluminum oxide, titanium oxide, zinc oxide, magnesium oxide, silicon oxide and strontium titanate added thereto.

4. The developing device as described in claim 1, wherein density of the toner included in said two-component developing agent is in a range from 1 to 20% by weight.

5. The developing device as described in claim 1, wherein said stirring-transfer means is disposed in a first quadrant and said developing roller is disposed in a third quadrant of orthogonal coordinate system having an origin at the center of rotation of the magnetic roller.

6. The developing device as described in claim 5, wherein a photosensitive body is disposed with a space kept from said developing roller in the third quadrant.

7. The developing device as described in claim 5, wherein a space region S is formed within a fourth quadrant or across the fourth and third quadrants.

8. The developing device as described in claim 7, wherein the photosensitive body disposed in the third quadrant of another adjacent developing device is located in said space region S.

9. The developing device as described in claim 5, wherein said magnetic roller comprises the magnetic sleeve and a stationary permanent magnet having a plurality of magnetic poles N1, S1, N2, N3 and S2 disposed in this order along the circumferential direction within said magnetic sleeve, and a region of the minimum perpendicular magnetization, that is formed between a pair of magnetic poles N2 and N3 of the same polarity by the repulsing magnetic force of the pair of magnetic poles, is located within a range of angles θ from 35 to 60 degrees in the first quadrant.

* * * * *